US011632616B2

(12) United States Patent
Chang

(10) Patent No.: US 11,632,616 B2
(45) Date of Patent: Apr. 18, 2023

(54) WIRELESS EARPHONES

(71) Applicant: NANJING SILERGY MICRO (HK) CO., LIMITED, Causeway Bay (HK)

(72) Inventor: Chia-Lin Chang, Taipei (TW)

(73) Assignee: NANJING SILERGY MICRO (HK) CO., LIMITED, Causeway Bay (HK)

( * ) Notice: Subject to any disclaimer, the term of this patent is extended or adjusted under 35 U.S.C. 154(b) by 43 days.

(21) Appl. No.: 17/477,610

(22) Filed: Sep. 17, 2021

(65) Prior Publication Data

US 2022/0167076 A1 May 26, 2022

(30) Foreign Application Priority Data

Nov. 20, 2020 (CN) ..... 202011308345.5

(51) Int. Cl.
*H04R 1/10* (2006.01)
*H01Q 1/27* (2006.01)

(52) U.S. Cl.
CPC ..... *H04R 1/1041* (2013.01); *H01Q 1/273* (2013.01); *H04R 2420/07* (2013.01)

(58) Field of Classification Search
CPC .. H04B 1/3838; H04B 5/0062; H04B 5/0012; H04B 1/3833; H04B 15/00; H04B 7/0426; H04B 1/0458; H04B 1/48; H04B 2001/0416; H04B 5/0043; H04W 4/70; H04W 4/80; H04W 88/06; H04W 52/0203; H04W 84/12; H04W 84/18; H04W 88/02; H04W 52/226; H04W 52/283; H04W 52/367; H04M 2250/12; H04R 1/1041; H04R 2420/07
USPC ..... 381/74, 312, 1–3; 700/94
See application file for complete search history.

(56) References Cited

U.S. PATENT DOCUMENTS

| | | | | |
|---|---|---|---|---|
| 10,182,505 | B2 * | 1/2019 | Ochii | H05K 5/0256 |
| 10,944,154 | B1 * | 3/2021 | Tong | H01Q 1/243 |
| 10,966,047 | B1 * | 3/2021 | Tong | H04R 5/033 |
| 11,374,319 | B2 * | 6/2022 | Kim | H01Q 1/44 |
| 2020/0103513 | A1 * | 4/2020 | Knaappila | H04B 17/27 |
| 2021/0211800 | A1 * | 7/2021 | Degraye | G10K 11/17854 |

* cited by examiner

*Primary Examiner* — Lun-See Lao
(74) *Attorney, Agent, or Firm* — Amin, Turocy & Watson, LLP

(57) ABSTRACT

Wireless earphones comprising a first antenna module, at least one second antenna module, a radio frequency module, a sensing module, a speaker module and a processing module. The radio frequency module is used to receive or transmit radio frequency signals by the first antenna module or the second antenna module; the sensing module is used to sense a capacitance value of a first parasitic capacitance of the first antenna module and generate a corresponding first sensing signal and used to sense a capacitance value of a second parasitic capacitance of the second antenna module and generate a corresponding second sensing signal; the speaker module is used to play audio signals; and the processing module is used to generate a control signal according to the radio frequency signal, the first sensing signal or the second sensing signal to control the speaker module to play the audio signal corresponding to the control signal.

15 Claims, 6 Drawing Sheets

WIRELESS EARPHONES

RELATED APPLICATIONS

The present application claims the priority of Chinese Application No. 202011308345.5, filed Nov. 20, 2020, the disclosure of which is hereby incorporated by reference herein in its entirety.

BACKGROUND OF THE INVENTION

1. Field of the Invention

The present disclosure generally relates to wireless earphones, and, more particularly, to wireless earphones capable of receiving user operation instructions.

2. Description of the Related Art

In general, true wireless stereo (TWS) earphones receive operation instructions or audio data from other devices, such as mobile phones, by an antenna. In a case of mobile phones, a user may conduct simultaneous video and audio communication by a mobile phone held by his/her hand, or listen to music on the mobile phone which is put in his/her pocket. In order to keep sufficient communication quality in various situations, multiple sets of antennas are required for the TWS earphones to receive radiation frequencies from different directions.

On the other hand, users would expect some functions, such as the function of wearing detection, i.e. off-ear and/or on-ear (or in-ear) detection, and gesture-control in the TWS earphones. However, the additional components to accomplish these functions would take up the inner space of the TWS earphones. It is difficult to meet all the above requirements in the prior art, due to the limited inner space of the TWS earphones. Therefore, how to provide wireless earphones that can receiving radio frequency signals in all directions and are capable of wearing detection and gesture-control has become an urgent problem to be solved in the industry.

SUMMARY OF THE INVENTION

In light of solving the foregoing problems of the prior art, the present invention provides wireless earphones that can receiving radio frequency signals in all directions and are capable of wearing detection and gesture-control.

The present invention provides wireless earphones comprising a first antenna module, at least one second antenna module, a radio frequency module, a sensing module, a speaker module and a processing module. The radio frequency module is coupled with the first antenna module and the second antenna module, and the radio frequency module is used to receive or transmit radio frequency signals by the first antenna module or the second antenna module; the sensing module is coupled with the first antenna module and the second antenna module, and the sensing module is used to sense a capacitance value of a first parasitic capacitance of the first antenna module and generate a corresponding first sensing signal and used to sense a capacitance value of a second parasitic capacitance of the second antenna module and generate a corresponding second sensing signal; the speaker module is used to play audio signals; and the processing module is connected with the radio frequency module, the sensing module and the speaker module, wherein the processing module is used to generate a control signal according to the radio frequency signal, the first sensing signal or the second sensing signal to control the speaker module to play the audio signal corresponding to the control signal.

In an embodiment, the first antenna module comprises a plurality of conductor elements; wherein the plurality of conductor elements are coupled to each other through a first capacitor structure.

In an embodiment, the first capacitor structure is a distributed capacitor structure or a lumped distributed capacitor structure.

In an embodiment, the radio frequency module is coupled with the first antenna module or the second antenna module through a second capacitor structure.

In an embodiment, the second capacitor structure is a distributed capacitor structure or a lumped distributed capacitor structure.

In an embodiment, the sensing module is coupled with the first antenna module or the second antenna module through a first inductor.

In an embodiment, the processing module is further used to determine the distance between a first object and the first antenna module or whether the first object contacts the first antenna module according to the first sensing signal.

In an embodiment, the processing module is further used to determine the distance between a second object and the second antenna module or whether the second object contacts the second antenna module according to the second sensing signal.

In an embodiment, the processing module is further used to determine the contact between a third object and the first antenna module and the contact between the third object and the second antenna module in chronological order according to the first sensing signal and the second sensing signal.

In an embodiment, the first antenna module or the second antenna module is disposed on a flexible printed circuit board.

In an embodiment, the first antenna module has a first radiation pattern and the second antenna module has a second radiation pattern, wherein a direction of the first radiation pattern and a direction of the second radiation pattern are different.

In an embodiment, the wireless earphones further comprise a radio frequency switch connected the radio frequency module with the first antenna module and the second antenna module, and the radio frequency switch is used to connect the radio frequency module to the first antenna module or connect the radio frequency module to the second antenna module according to strength of the radio frequency signals received or transmitted by the first antenna module and the second antenna module.

In an embodiment, the wireless earphones further comprise a storage module connected with the processing module, and the storage module is used to store digital information.

In an embodiment, the wireless earphones further comprise a power module connected with the processing module, and the power module is used to supply required power to the radio frequency module, the sensing module, the speaker module and the processing module for the operation thereof.

In an embodiment, the wireless earphones further comprise a microphone module connected with the processing module, and the microphone module is used to convert an external audio signal into a digital audio signal.

Compared to the prior art, the wireless earphones according to the present invention comprise a first antenna module, at least one second antenna module and a radio frequency module. The first antenna module and the second antenna module may receive radio frequency signals from different directions to ensure good communication quality in various in-use situations. The wireless earphones according to the present invention further comprise a sensing module. The sensing module shares the first antenna module and the second antenna module with the radio frequency module. This may accomplish the function of wearing detection and gesture-control in the wireless earphones of the present invention without adding additional components. Besides, the wireless earphones according to the present invention may further comprise a first capacitor structure, a second capacitor structure or a first inductor to separate or isolate the transmitted or received signals among every components. The wireless earphones according to the present invention may further comprise a storage module or a microphone module to enhance the additional functionality.

DETAILED DESCRIPTION

The present invention is described by the following specific embodiments. Those with ordinary skills in the arts can readily understand other advantages and functions of the present invention after reading the disclosure of this specification. Any changes or adjustments made to their relative relationships, without modifying the substantial technical contents, are also to be construed as within the range implementable by the present invention.

Figure 1:
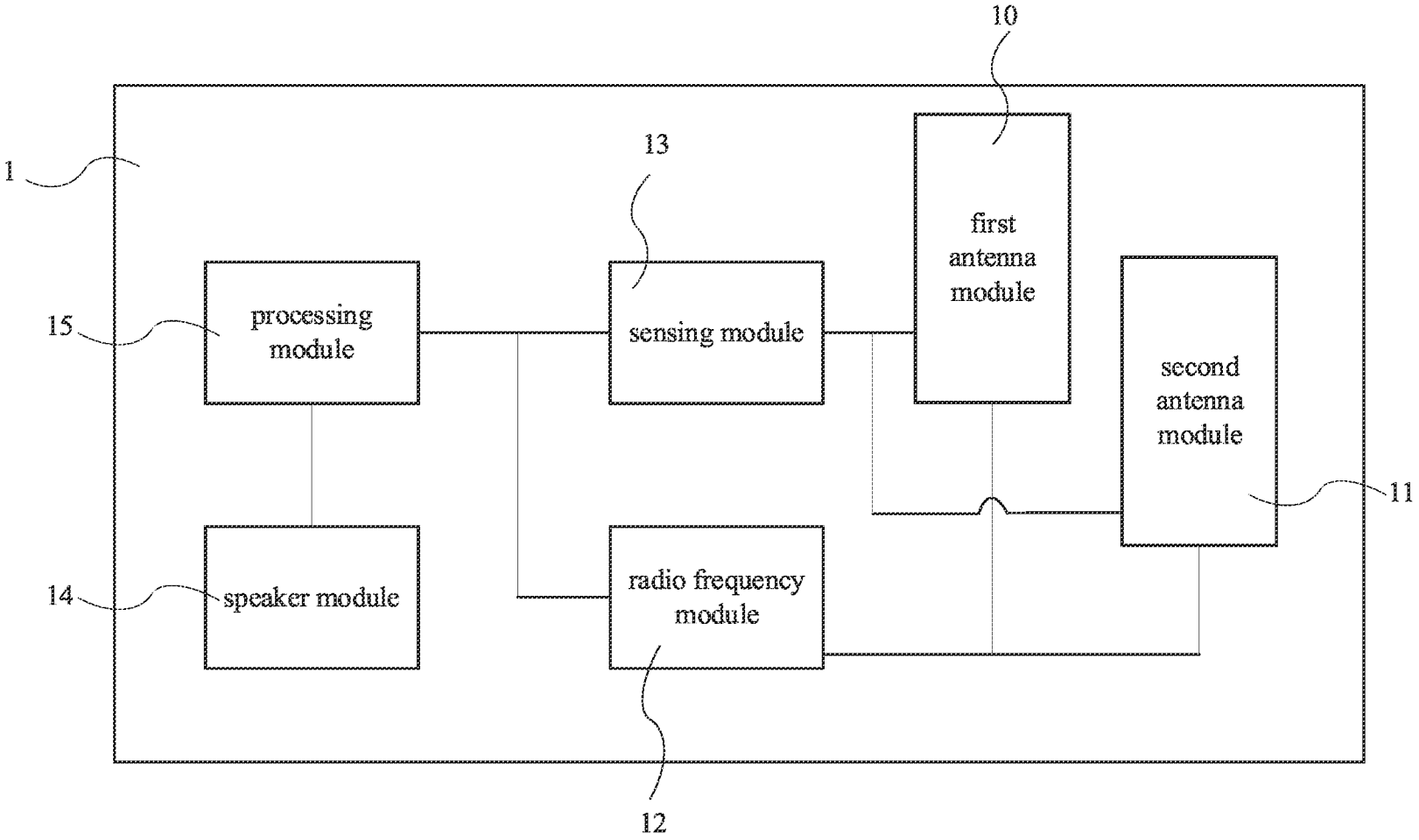
FIG. 1 illustrates a schematic view of a structure of the wireless earphones according to a first embodiment of the present invention.

Please refer to FIG. 1. FIG. 1 illustrates a schematic view of a structure of the wireless earphones according to a first embodiment of the present invention. As shown in the figure, the wireless earphones 1 according to the present invention comprise a first antenna module 10, at least one second antenna module 11, a radio frequency module 12, a sensing module 13, a speaker module 14 and a processing module 15.

The radio frequency module 12 is coupled with the first antenna module 10 and the second antenna module 11. The radio frequency module 12 is used to receive or transmit radio frequency signals by the first antenna module 10 or the second antenna module 11. The first antenna module 10 has a first radiation pattern and the second antenna module 11 has a second radiation pattern, wherein a direction of the first radiation pattern and a direction of the second radiation pattern may be different to receive radio frequency signals from different directions to ensure good communication quality in various in-use situations. In this embodiment, the wireless earphones comprise a second antenna module 11, but in other embodiments, the wireless earphones 1 may comprise more second antenna modules 11 to extend the coverage of the antenna for receiving signals. For example, the radio frequency signal can be, but not limited to, electromagnetic wave signals in Wi-Fi frequency band, LTE frequency band or 5G New Radio frequency band under the standards thereof.

The sensing module 13 is coupled with the first antenna module 10 and the second antenna module 11. The sensing module 13 is used to sense a capacitance value of a first parasitic capacitance of the first antenna module 10 and generate a corresponding first sensing signal and used to sense a capacitance value of a second parasitic capacitance of the second antenna module 11 and generate a corresponding second sensing signal. The sensing module 13 generates the corresponding sensing signal according to a change of the capacitance value. The change of the capacitance value is a low frequency signal. Whether the first antenna module 10 or the second antenna module 11 is touched by an object, such as a part of a human body, or the first antenna module 10 or the second antenna module 11 is approached by an object, such as a part of a human body in a predetermined distance can be determined according to the capacitance value measured by the sensing module 13.

The speaker module 14 is used to play audio signals. The processing module 15 is connected with the radio frequency module 12, the sensing module 13 and the speaker module 14. The processing module 15 is used to generate a control signal according to the radio frequency signal, the first sensing signal or the second sensing signal to control the speaker module 14 to play the audio signal corresponding to the control signal. For example, the radio frequency signal can comprise signals from mobile phones or other devices, such as music, sound, or operating signals. The first sensing signal and/or the second sensing signal herein can mean a contact of the object, such as a part of a human body, e.g. touch by hands or fingers, or the wireless earphones 1 being worn on/in ear. The processing module 15 can convert the first sensing signal or the second sensing signal into corresponding operation instructions, such as increasing or decreasing the volume of the played audio, or mute. The processing module 15 may be, for example, a processor chip.

Figure 2:
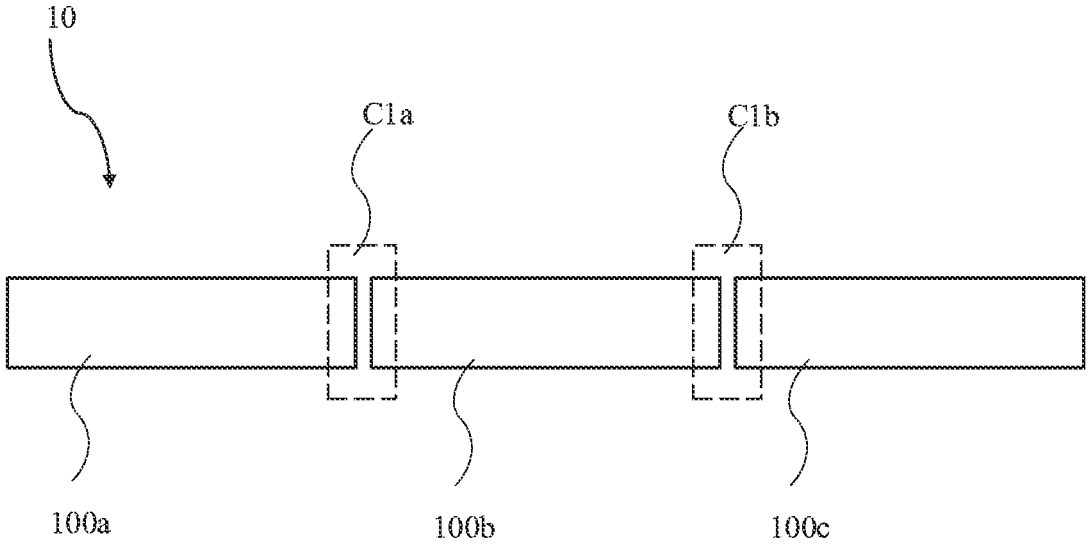
FIG. 2 illustrates a schematic view of a structure of the first antenna module according to a second embodiment of the present invention.

Please refer to FIG. 2. FIG. 2 illustrates a schematic view of a structure of the wireless earphones according to a second embodiment of the present invention. In an embodiment, the first antenna module 10 may comprise a plurality of conductor elements 100*a*, 100*b*, and 100*c*. The conductor elements 100*a*, 100*b*, and 100*c* are coupled through first capacitor structures C1*a* and C1*b*. The first capacitor structures C1*a* and C1*b* can isolate the low frequency signals among the conductor elements 100*a*, 100*b*, and 100*c*. Furthermore, because the change of the capacitance value of the parasitic capacitance is a low frequency signal, the isolation of the low frequency signals among the conductor elements 100*a*, 100*b*, and 100*c* indicate that the change of the capacitance value of the parasitic capacitance of each of the conductor elements 100*a*, 100*b*, and 100*c* can be sensed individually. As a result, the sensing module 13 can sense the gesture or the sequence or the order of the contacts by the user by the conductor elements 100*a*, 100*b*, and 100*c*, more than the contacts between the user and the conductor elements. In other embodiments, the first antenna 10 may comprise different numbers of conductor elements, such as two or more.

In an embodiment, the first capacitor structures C1*a* and C1*b* may be distributed capacitor structures. For example, the distributed first capacitor structure C1*a* can be formed by reducing the distance between adjacent conductor elements 100*a* and 100*b* and making the shape of the edge of the conductor element 100*a* correspond to the shape of the edge of the conductor element 100*b*.

In another embodiment, the first capacitor structures C1*a* and C1*b* may be lumped distributed capacitor structures disposed among the conductor elements 100*a*, 100*b*, and 100*c*. For example, the lumped distributed capacitor structure may be a multi-layer ceramic capacitor (MLCC), but not limited to.

Figure 3:
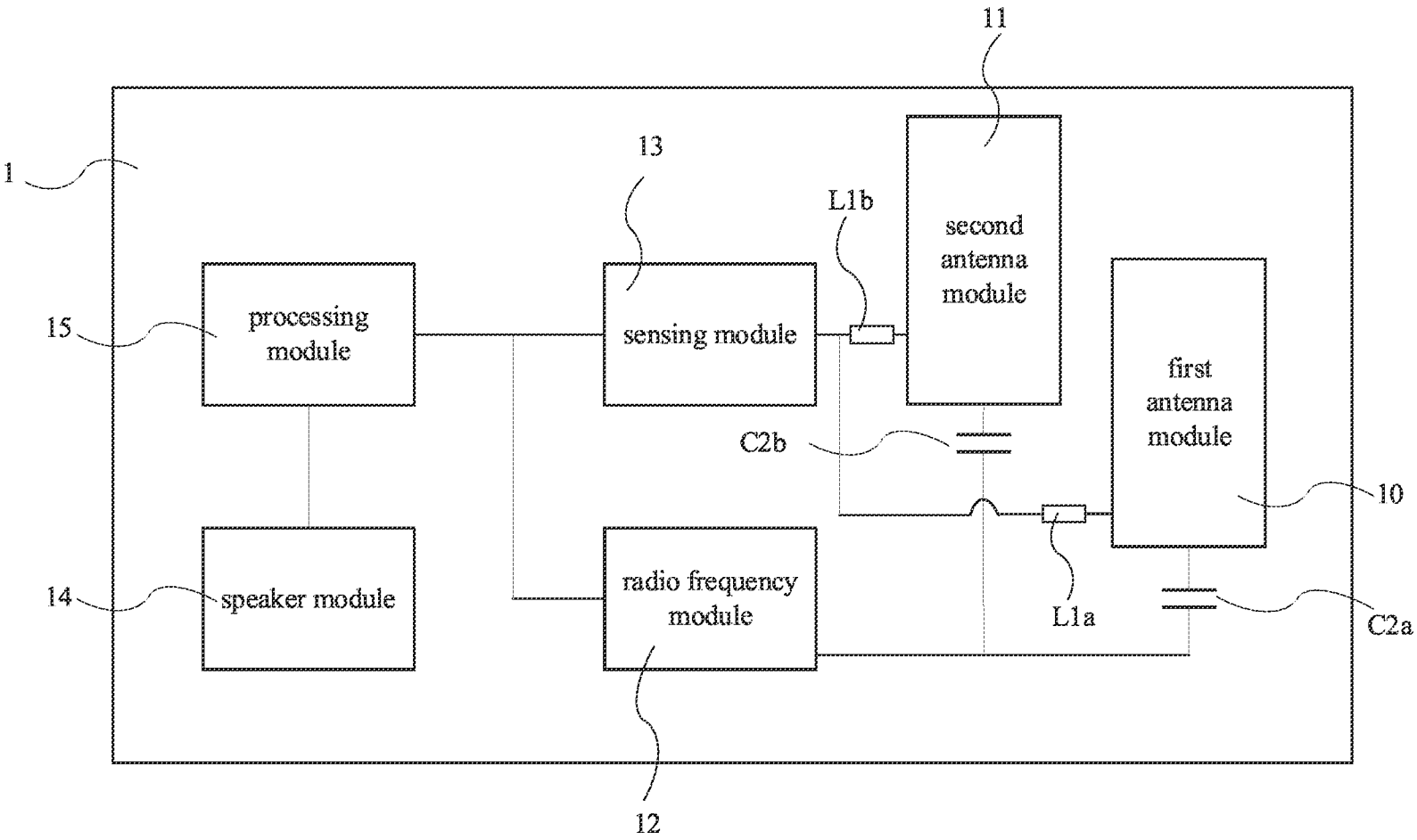
FIG. 3 illustrates schematic views of a structure of the wireless earphones according to a third embodiment of the present invention.

Please refer to FIG. 3. FIG. 3 illustrates a schematic view of a structure of the wireless earphones according to a third embodiment of the present invention. In an embodiment, the radio frequency module 12 is coupled with the first antenna module 10 through a second capacitor structure C2*a* and the radio frequency module 12 is coupled with the second antenna module 11 through a second capacitor structure C2*b*.

In an embodiment, the second capacitor structures C2*a*, C2*b* may be distributed capacitor structures or a lumped distributed capacitor structures. The capacitor structures of the second capacitor structures C2*a*, C2*b* may be identical to or different from those of the first capacitor structures C1*a*, C1*b*.

In an embodiment, the sensing module 13 may be coupled with the first antenna modules 10 through a first inductor L1*a* and the sensing module 13 may be coupled with the second antenna modules 11 through a first inductor L1*b*. The second capacitor structures C2*a*, C2*b* can isolate the low frequency signals, and the first inductors L1*a*, L1*b* can isolate the high frequency signals. Therefore, the radio frequency module 12 and the sensing module 13 will not interfere with each other. The radio frequency module 12 and the sensing module 13 can share the first antenna module 10 and the second antenna module 11 as radiators, thereby saving cost and component space.

In an embodiment, the processing module 15 is further used to determine the distance between a first object (such as a part, e.g. hand, of a human body) and the first antenna module 10 or whether the first object contacts the first antenna module 10 according to the first sensing signal. In other words, the wireless earphones 1 of the present invention have a function of gesture-control. The users may input operation instructions by touching the wireless earphones 1.

In an embodiment, the processing module 15 is further used to determine the distance between a second object (such as a part, e.g. ear, of a human body) and the second antenna module 11 or whether the second object contacts the second antenna module 11 according to the second sensing signal. In other words, the wireless earphones 1 of the present invention have a function of wearing detection, i.e. off-ear and/or on-ear (or in-ear) detection to sense whether the wireless earphones 1 are being worn.

Figure 4:
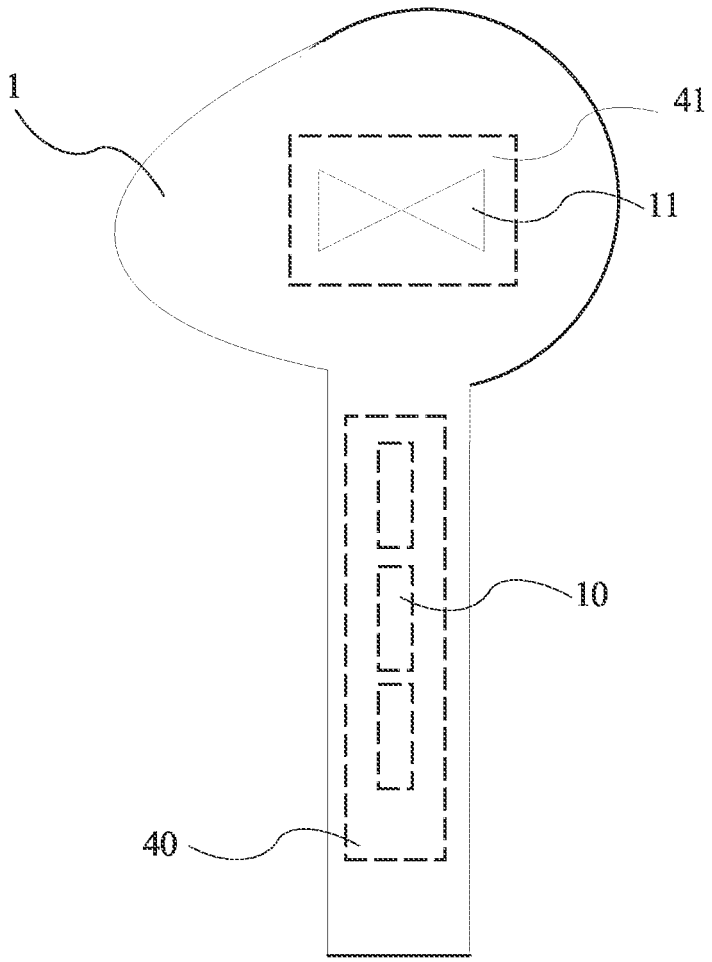
FIG. 4 illustrates schematic views of a structure of the wireless earphones according to a fourth embodiment of the present invention.

Please refer to FIG. 4. FIG. 4 illustrates a schematic view of a structure of the wireless earphones according to a fourth embodiment of the present invention. In an embodiment, the first antenna module 10 can be disposed on a flexible printed circuit board 40. The first antenna module 10 of this embodiment comprises three rectangular conductor elements, but not limited to. The second antenna module 11 can be disposed on a flexible printed circuit board 41. The second antenna module 11 of this embodiment comprises two triangular conductor elements, but not limited to. In other embodiments, the first antenna module 10 and the second antenna module 11 may be disposed on the same flexible printed circuit board.

In an embodiment, the processing module 15 is further used to determine the contact between a third object and the first antenna module 10 and the contact between the third object and the second antenna module 11 in chronological order according to the first sensing signal and the second sensing signal. The second antenna module may be used to sense the gesture-control. For example, the sequence or the order of the contacts between the object, such as a part of a human body and the first antenna module 10 and the second antenna module 11 represents a specific gesture. For example, touching the first antenna module 10 and then the second antenna module 11 in sequence represents a first gesture, and touching the second antenna module 11 and then the first antenna module 10 in sequence represents a second gesture. The processing module 15 can generate corresponding control signals according to these gestures.

In an embodiment, the first antenna module 10 has a first radiation pattern and the second antenna module 11 has a second radiation pattern, wherein a direction of the first radiation pattern and a direction of the second radiation pattern are different. For example, the first radiation pattern of the first antenna module 10 may have a direction downward, which corresponds to the situation that the mobile phone is put on the users; and the second radiation pattern of the second antenna module 11 may have a direction forward, which corresponds to the situation that the mobile phone is held in front of the users, but not limited to. In other embodiments, the direction of the first radiation pattern of the first antenna module 10 and the direction of the second radiation pattern of the second antenna module 11 can be set or more second antenna modules 11 can be disposed for various in-use situations.

Figure 5:
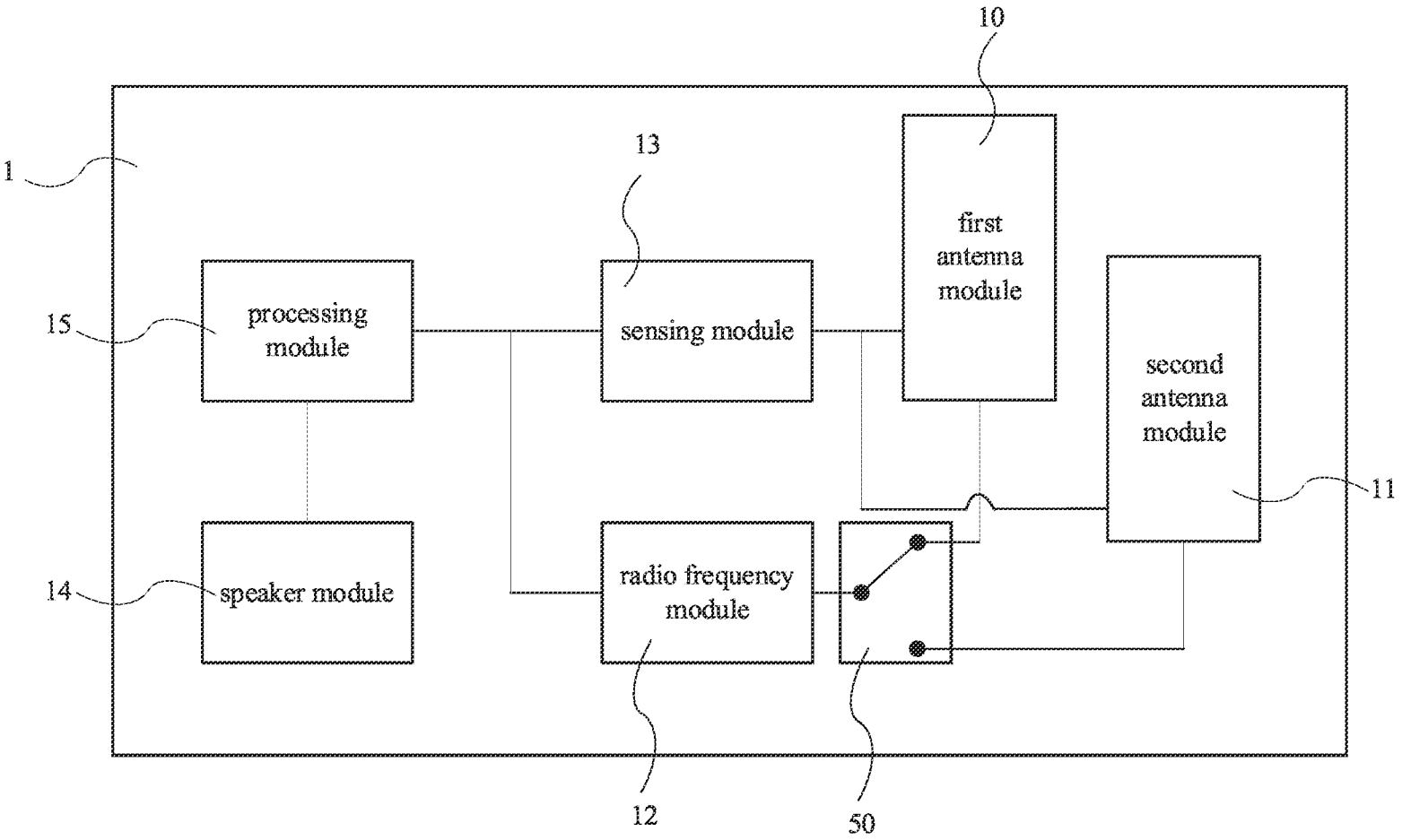
FIG. 5 illustrates schematic views of a structure of the wireless earphones according to a fifth embodiment of the present invention.

Please refer to FIG. 5. FIG. 5 illustrates a schematic view of a structure of the wireless earphones according to a fifth embodiment of the present invention. In an embodiment, the wireless earphones 1 may further comprise a radio frequency switch 50 connected the radio frequency module 12 with the first antenna module 10 and the second antenna module 11. The radio frequency switch 50 is used to connect the radio frequency module 12 to the first antenna module 10 or connect the radio frequency module 12 to the second antenna module 11 according to strength of the radio frequency signals received or transmitted by the first antenna module 10 and the second antenna module 11. For example, when the radio frequency signals received by the first antenna module 10 is stronger, the radio frequency switch 50 would connect the electric circuit between the radio frequency module 12 and the first antenna module 10 to keep better communication quality.

Figure 6:
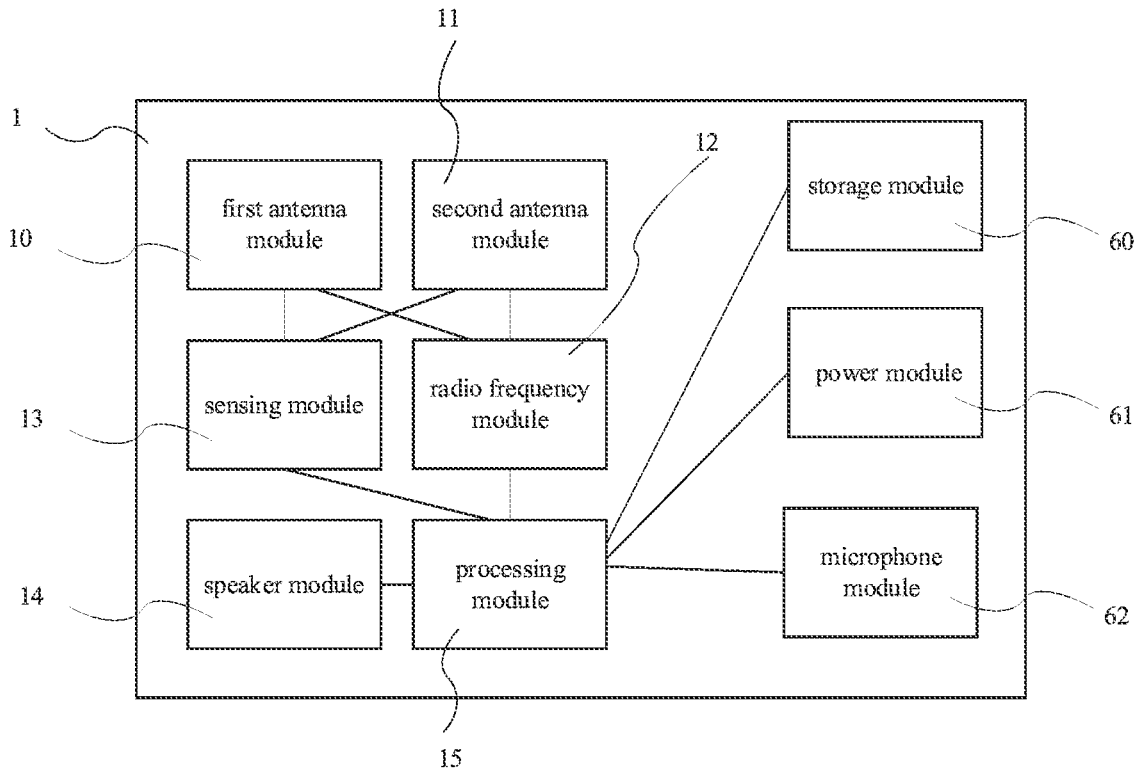
FIG. 6 illustrates a block diagram of the wireless earphones according to a sixth embodiment of the present invention.

FIG. 6 illustrates a block diagram of the wireless earphones according to a sixth embodiment of the present invention. In an embodiment, the wireless earphones 1 can further comprise a storage module 60. The storage module 60 is connected with the processing module 15, and the storage module 60 is used to store digital information. For example, the storage module 60 can be, but not limited to, a storage chip.

In an embodiment, the wireless earphones 1 can further comprise a power module 61. The power module 61 is connected with the processing module 15, and the power module 61 is used to supply required power to the radio frequency module 12, the sensing module 13, the speaker module 14, the processing module 15 and other modules for the operation thereof. For example, but not limited to, the power module 61 can be a lithium battery.

In an embodiment, the wireless earphones 1 can further comprise a microphone module 62. The microphone module 62 is connected with the processing module 15, and the microphone module 62 is used to convert an external audio signal into a digital audio signal.

In summary, the wireless earphones according to the present invention comprise a first antenna module, at least one second antenna module and a radio frequency module. The first antenna module and the second antenna module may receive radio frequency signals from different directions to ensure good communication quality in various in-use situations. The wireless earphones according to the present invention further comprise a sensing module. The sensing module shares the first antenna module and the second antenna module with the radio frequency module. This may accomplish the function of wearing detection and gesture-control in the wireless earphones of the present invention without adding additional components. Besides, the wireless earphones according to the present invention may further comprise a first capacitor structure, a second capacitor structure or a first inductor to separate or isolate the transmitted or received signals among every components. The wireless earphones according to the present invention may further comprise a storage module or a microphone module to enhance the additional functionality.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. Wireless earphones, comprising:

a first antenna module;

at least one second antenna module;

a radio frequency module coupled with the first antenna module and the second antenna module, and the radio frequency module is used to receive or transmit radio frequency signals by the first antenna module or the second antenna module;

a sensing module coupled with the first antenna module and the second antenna module, and the sensing module is used to sense a capacitance value of a first parasitic capacitance of the first antenna module and generate a corresponding first sensing signal and used to sense a capacitance value of a second parasitic capacitance of the second antenna module and generate a corresponding second sensing signal;

a speaker module used to play audio signals; and a processing module connected with the radio frequency module, the sensing module and the speaker module, wherein the processing module is used to generate a control signal according to the radio frequency signal, the first sensing signal or the second sensing signal to control the speaker module to play the audio signal corresponding to the control signal.

2. The wireless earphones of claim 1, wherein the first antenna module comprises a plurality of conductor elements; wherein the plurality of conductor elements are coupled to each other through a first capacitor structure.

3. The wireless earphones of claim 2, wherein the first capacitor structure is a distributed capacitor structure or a lumped distributed capacitor structure.

4. The wireless earphones of claim 1, wherein the radio frequency module is coupled with the first antenna module or the second antenna module through a second capacitor structure.

5. The wireless earphones of claim 4, wherein the second capacitor structure is a distributed capacitor structure or a lumped distributed capacitor structure.

6. The wireless earphones of claim 1, wherein the sensing module is coupled with the first antenna module or the second antenna module through a first inductor.

7. The wireless earphones of claim 1, wherein the processing module is further used to determine the distance between a first object and the first antenna module or whether the first object contacts the first antenna module according to the first sensing signal.

8. The wireless earphones of claim 1, wherein the processing module is further used to determine the distance between a second object and the second antenna module or whether the second object contacts the second antenna module according to the second sensing signal.

9. The wireless earphones of claim 1, wherein the processing module is further used to determine the contact between a third object and the first antenna module and the contact between the third object and the second antenna module in chronological order according to the first sensing signal and the second sensing signal.

10. The wireless earphones of claim 1, wherein the first antenna module or the second antenna module is disposed on a flexible printed circuit board.

11. The wireless earphones of claim 1, wherein the first antenna module has a first radiation pattern and the second antenna module has a second radiation pattern, wherein a direction of the first radiation pattern and a direction of the second radiation pattern are different.

12. The wireless earphones of claim 1, further comprising:

a radio frequency switch connected the radio frequency module with the first antenna module and the second antenna module, and the radio frequency switch is used to connect the radio frequency module to the first antenna module or the radio frequency module to the second antenna module according to strength of the radio frequency signals received or transmitted by the first antenna module and the second antenna module.

13. The wireless earphones of claim 1, further comprising:

a storage module connected with the processing module, and the storage module is used to store digital information.

14. The wireless earphones of claim 1, further comprising:

a power module connected with the processing module, and the power module is used to supply required power to the radio frequency module, the sensing module, the speaker module and the processing module for the operation thereof.

15. The wireless earphones of claim 1, further comprising:

a microphone module connected with the processing module, and the microphone module is used to convert an external audio signal into a digital audio signal.

* * * * *